US009522417B2

(12) United States Patent
Cernuschi et al.

(10) Patent No.: US 9,522,417 B2
(45) Date of Patent: Dec. 20, 2016

(54) ROLLING STAND WITH SKEWED WORKING ROLLS AND A ROLL PRELOADING DEVICE

(71) Applicant: Danieli & C. Officine Meccaniche S.P.A., Buttrio (IT)

(72) Inventors: Ettore Cernuschi, Castelletto Sopra Ticino (IT); Claudio Maria Scalmana, Milan (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 227 days.

(21) Appl. No.: 14/373,007

(22) PCT Filed: Jan. 18, 2013

(86) PCT No.: PCT/EP2013/050904

§ 371 (c)(1),
(2) Date: Jul. 17, 2014

(87) PCT Pub. No.: WO2013/107845

PCT Pub. Date: Jul. 25, 2013

(65) Prior Publication Data

US 2015/0000363 A1 Jan. 1, 2015

(30) Foreign Application Priority Data

Jan. 20, 2012 (IT) ..... MI2012A0057

(51) Int. Cl.
*B21B 19/12* (2006.01)
*B21B 19/04* (2006.01)
(Continued)

(52) U.S. Cl.
CPC ..... *B21B 19/12* (2013.01); *B21B 19/04* (2013.01); *B21B 31/028* (2013.01); *B21B 31/10* (2013.01);
(Continued)

(58) Field of Classification Search
CPC ..... B21B 19/02; B21B 19/04; B21B 2203/06; B21B 31/02; B21B 31/04; B21B 35/14; B21B 31/028; B21B 13/14; B21B 19/12; B21B 2203/36; B21B 23/00; B21B 31/10; B21B 31/32
See application file for complete search history.

(56) References Cited

U.S. PATENT DOCUMENTS 5,295,379 A * 3/1994 Trbovich ..... B21B 19/04 72/95
6,202,459 B1 * 3/2001 Palzer ..... B21B 37/64 72/11.6
6,266,987 B1 * 7/2001 Goto ..... B21B 31/08 72/238

FOREIGN PATENT DOCUMENTS

EP 0619150 A1 12/1994
EP 1151808 A2 11/2001
GB 1186671 4/1970

* cited by examiner

*Primary Examiner* — Peter DungBa Vo
*Assistant Examiner* — John S Lowe
(74) *Attorney, Agent, or Firm* — Stetina Brunda Garred & Brucker

(57) ABSTRACT

The rolling stand comprises four support columns (2), two conical rolling rolls with skewed rolling axes which are oblique to each other and are fixed to two roll cradles (6, 7), four jacks (24, 26) below the lower roll cradle (7) for exercising a preloading force on such a roll cradle. Four jacks (20, 21, 22, 23) are arranged above to exercise a preloading force on the upper roll cradle (6) during rolling. The stand also comprises four upper hydraulic capsules (((30, 32, 33, 40, 42, 43) and four lower hydraulic capsules (37, 46), 47) for exercising push forces and controlling the upper (6) and lower (7) roll cradles and the rolling position of the working rolls.

12 Claims, 13 Drawing Sheets

(51) Int. Cl.

| | |
|---|---|
| ***B21B 31/02*** | (2006.01) |
| ***B21B 31/10*** | (2006.01) |
| *B21B 31/32* | (2006.01) |
| *B21B 23/00* | (2006.01) |

(52) U.S. Cl.
CPC ..... *B21B 23/00* (2013.01); *B21B 31/32* (2013.01); *Y10T 29/49547* (2015.01)

C–C

E–E

D–D

ROLLING STAND WITH SKEWED WORKING ROLLS AND A ROLL PRELOADING DEVICE

CROSS REFERENCE TO RELATED APPLICATIONS

The present application claims priority to PCT International Application No. PCT/EP2013/050904 filed on Jan. 18, 2013, which application claims priority to Italian Patent Application No. MI2012A000057 filed Jan. 20, 2012, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

Field of the Invention

The invention relates to rolling stands with working rolls having skewed axes for manufacturing seamless tubular bodies.

State of the Art

Generally, rolling mills with two skewed working roll axes, and in particular among other things modern piercing mills, used to pierce round billets in rolling mills for seamless tubes, provide a stand structure, or frame, which supports the loads generated by the deformation of the material during rolling, and roll cradles which support the working rolls. The adjustment of the existing feed angle is also provided between the two working rolls, their skewed rotation axes being oblique to each other.

Indeed, in order to allow the rolling of various products with the same rolling stand, in particular billets of various diameters, there is a practical need to modify the feed angle, which is the angle formed by the two skewed axes and which is measured with respect to the rolling axis, in order to contain the torques and forces generated in the machine.

Furthermore, modern rolling mills allow the adjustment of the distance between the working rolls. In particular, such adjustment devices are electromechanical jack screws, through which the forces of separation generated between the working rolls are discharged at the ends of the structure. These electromechanical jack screws are normally two in number for each working roll, in certain cases four jack screws are employed. The jack screws are normally assembled on the lower part of the rolling stand, fixed to the stand structure, while they are generally assembled jack screws on movable parts of the frame, tilting or shifting to allow the replacement of the working rolls and of the roll cradles.

Due to the normal elasticity of the stand structure, there may be a separation of the working rolls from each other by some mm, for example up to 3-5 mm, when they are under load. This settlement may not always be compensated for by adjusting the electromechanical jack screws, that is by pre-closing them, due to interference with the side guide systems. In particular, when the mill stand has disc guides, the latter require being positioned almost in contact with the working rolls and hence a pre-closure involves the risk of contact and damage between roll and disc. Furthermore, in the steps of rolling the head and the tail of the piece, two steps in which the separating forces are reduced, there is a thinning of the rolled section due to the automatic closing of the structure due to the elastic return of the elements caused by the decrease in the separating force.

Publication EP619150A describes a rolling mill similar to the one described above, in which the jack screws are assembled fixed on the structure and where the disengagement of the roll cradle to replace the pair of working rolls is obtained with bayonet fastening and, consequently the rolling stand is not to be equipped with a movable cap as in other solutions of the state of the art.

SUMMARY OF THE INVENTION

The primary object of the present invention is to make a conical roll rolling stand with a device which ensures a preloading of the rolls.

A further object of this invention consists in making a more affordable rolling stand, but with a more rigid structure.

A further object of the invention is to make a stand in which the pair of rolls may be simpler and faster to replace.

These and other objects are achieved by a rolling stand defining a rolling axis in which, according to claim 1, the following are provided a support structure having a longitudinal axis which is orthogonal to the rolling axis, a first and a second working roll having peripheral surfaces facing each other and defining a rolling passage, said first and second rolls having skewed rolling axes, a first and a second roll cradle, in which said first roll cradle integrally supports the first working roll and the second roll cradle integrally supports the second working roll, characterized in that it provides at least two first hydraulic jacks arranged and configured to exercise first push forces on first surfaces of the second roll cradle which are distal from the rolling passage, at least two second hydraulic jacks arranged and configured to exercise second push forces in the opposite direction to the first push forces on the surfaces of the first roll cradle which are distal from the rolling passage, at least two first hydraulic capsules arranged and configured to exercise third push forces on the surfaces of the first roll cradle which are proximal to the rolling passage and to define the reciprocal distance between the first and the second roll cradle, at least two second hydraulic capsules arranged and configured to exercise fourth push forces on the surfaces of the second roll cradle which are proximal with respect to the rolling passage and to define the reciprocal distance between the first and the second roll cradle in cooperation with the at least two first hydraulic capsules, means for controlling the position of said first and second roll cradles configured to control the position and forces of the at least two first hydraulic capsules and of the at least two second hydraulic capsules, of the forces of the at least two first jacks and of the at least two second jacks.

The rolling stand of the invention provides respective clearances of hydraulic capsules which act on the two upper and lower roll cradles and are arranged in the inner space between one roll cradle and the other. The capsules have the object of defining the distance between the roll cradles by means of a position control performed by suitable means. The capsules being positioned between the two roll cradles, and close to the rolling axis, the distance between the working rolls is not affected by the compliance of the entire stand structure and consequently, there are fewer compliance under load. Furthermore, instead of electromechanical jack screws there are hydraulic jacks which operate at a constant pressure and with the rod which is neither completely extended, nor completely retracted, so as to absorb the different deformations of the structure without altering the position of the roll cradle which remains in contact on the inner support capsules provided for each of the roll cradles. Advantageously, the jacks contrast the inner capsules, and are coaxial thereto, hence it's also possible in this case to make a stand frame without upper movable cap by turning to the insertion of roll cradles with bayonet coupling system on the frame.

Devices are also advantageously provided in the rolling stand, which are related to the angular adjustment of the roll cradles and the guide device of the plug bar outbound from the stand, known as internal bar steadier. This device is generally made with three guide rolls assembled within the stand.

Furthermore, the solution proposed allows the adjustment of the position of the rolls under load because there are no electromechanical jack screws, which are difficult to actuate when the working rolls are under load, and they are instead replaced by capsules and hydraulic jacks.

In a second aspect of the invention, the problems mentioned are resolved by means of a method for assembling a rolling stand as above, comprising the following steps a) positioning the second roll cradle in an angular position rotated by an angle δ2, about the longitudinal axis with respect to its predetermined final working position and shifting the second roll cradle in the direction of the longitudinal axis within the support structure of the rolling stand structure to an abutting position at the first hydraulic jacks, b) rotating the second roll cradle by an angle δ2 about the longitudinal axis, so that each lobe is placed at the respective first hydraulic jack and arranging the second roll cradle in its working position, c) positioning the first roll cradle in an angular position rotated by an angle δ1, about the longitudinal axis with respect to its predetermined final working position and shifting the first roll cradle in the direction of the longitudinal axis within the support structure of the rolling stand to an abutting position at the first hydraulic capsules, d) rotating the first roll cradle by an angle δ1 about the longitudinal axis, so that each lobe is placed at the respective first capsule and placing the first roll cradle in its working position.

A further advantage for the rolling operation resulting from the rolling stand structure according to the invention is to make the adjustment possible of the distance between the roll cradles along the longitudinal axis of the stand even when they are under load, that is while the metal product is rolled.

The dependent claims refer to preferred embodiments of the invention.

BRIEF DESCRIPTION OF THE FIGURES

Further features and advantages of the invention will be more apparent in light of the detailed description of preferred, but not exclusive, embodiments of a rolling stand with conical working rolls having skewed axes with a preloading device according to the invention, shown by way of non-limiting example, with the aid of the accompanying drawings in which.

The same numbers in the figures correspond to the same elements or components.

DETAILED DESCRIPTION OF PREFERRED EMBODIMENTS OF THE INVENTION

Figure 1A:
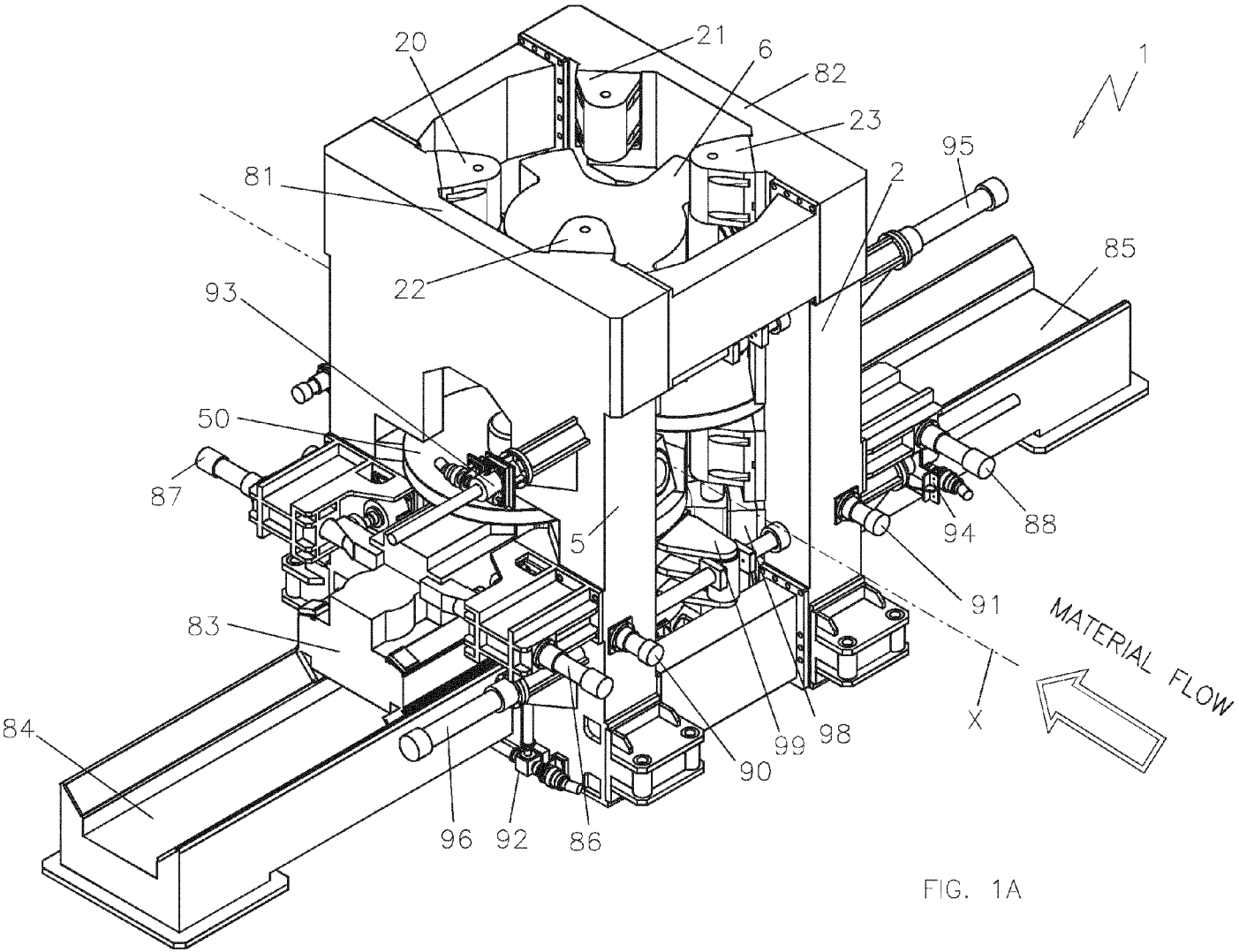
FIG. 1A shows an axonometric view of the rolling material inlet side of the rolling stand of the invention.
Figure 1B:
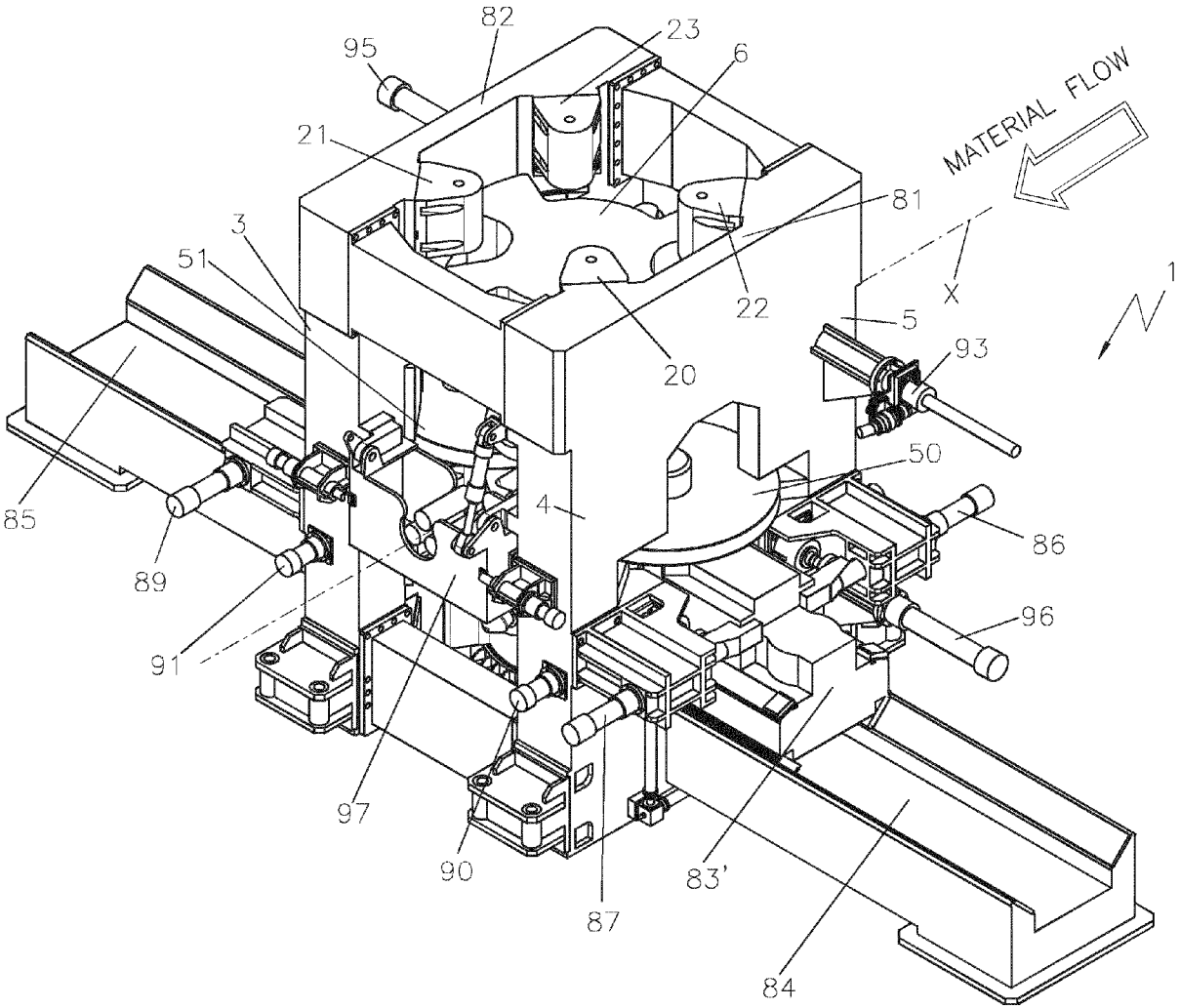
FIG. 1B shows an axonometric view of the rolled material outlet side of the rolling stand in FIG. 1A.
Figure 1C:
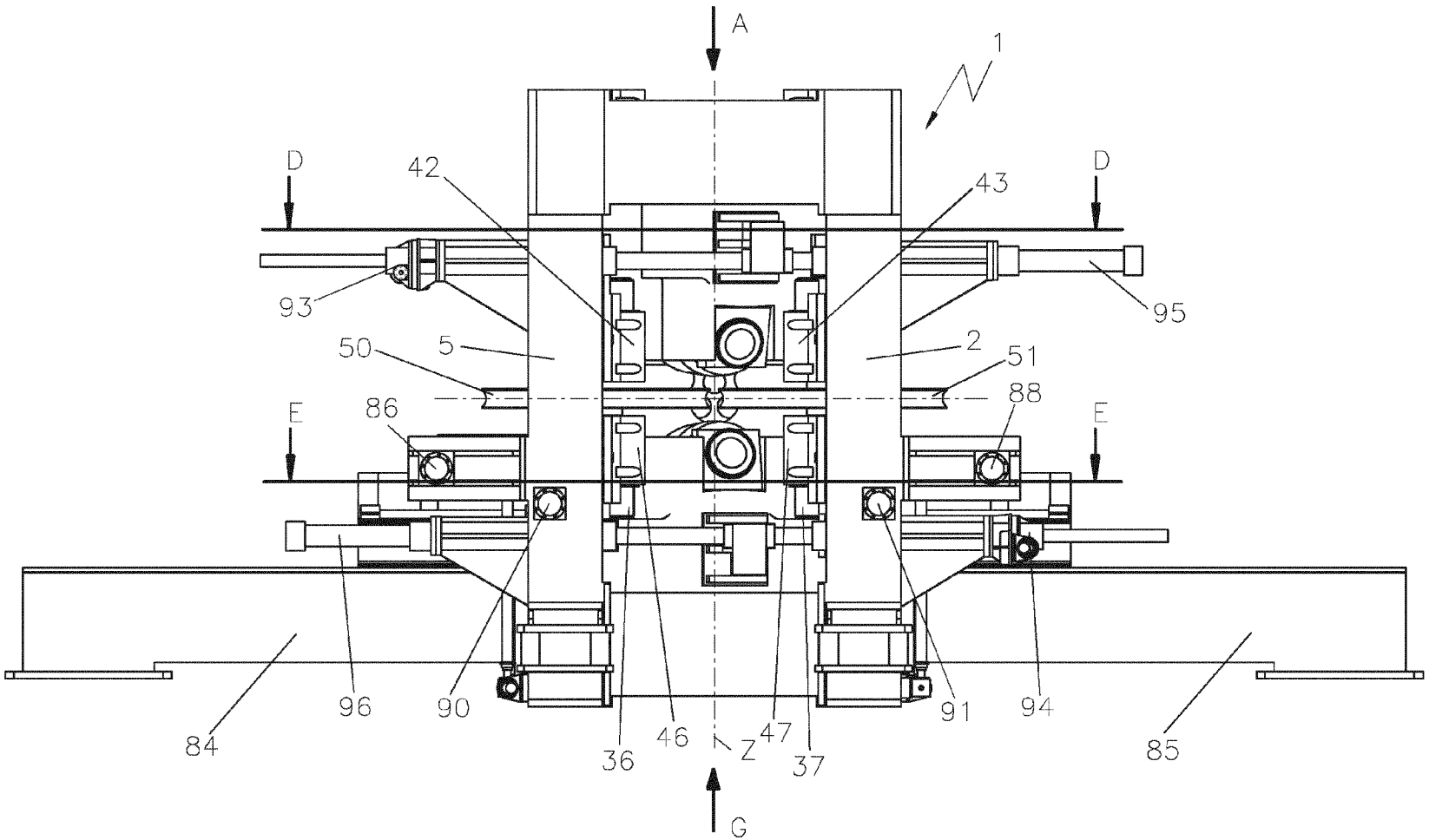
FIG. 1C shows a front view of the material inlet side of the rolling stand in FIG. 1A.
Figure 1D:
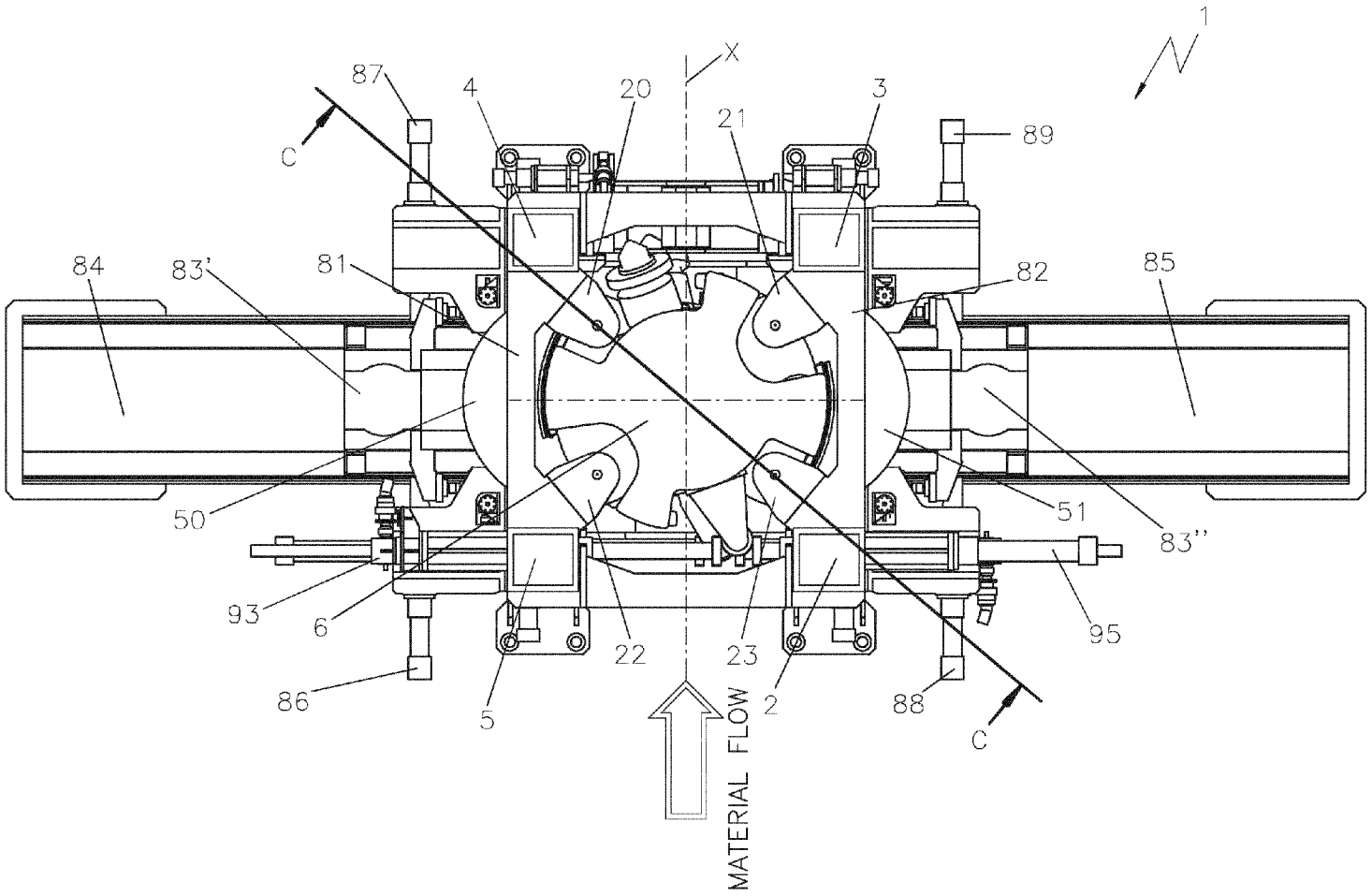
FIG. 1D shows a view in the direction of arrow A of the rolling stand in FIG. 1A.
Figure 2A:
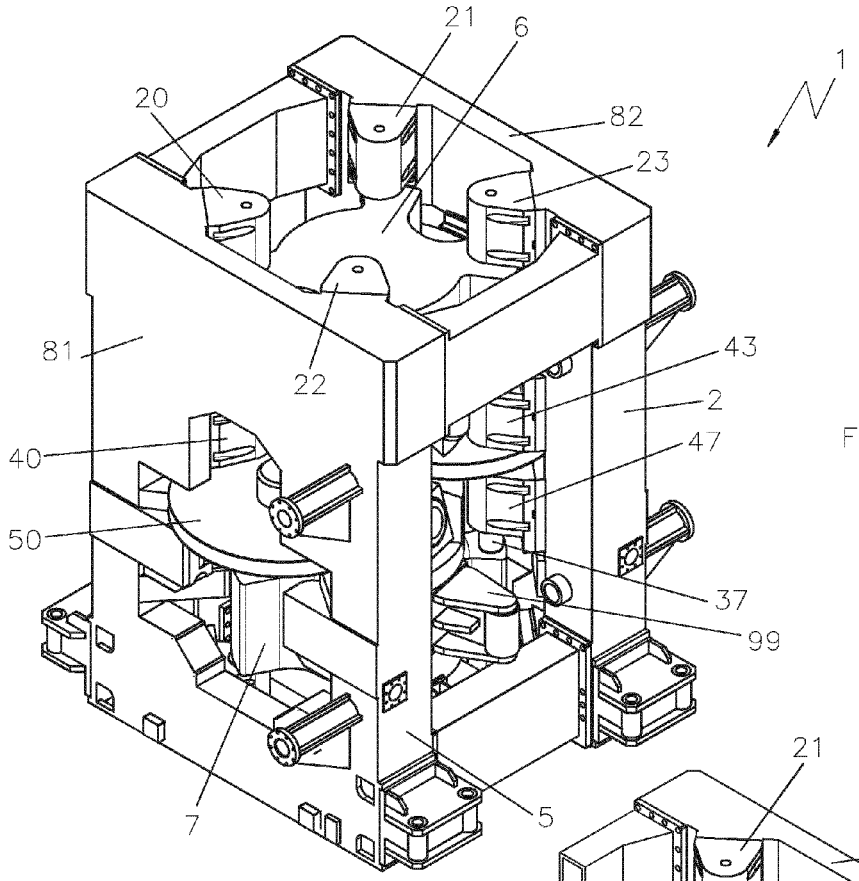
FIG. 2A shows an axonometric view of a component of the rolling stand in FIG. 1A.
Figure 2B:
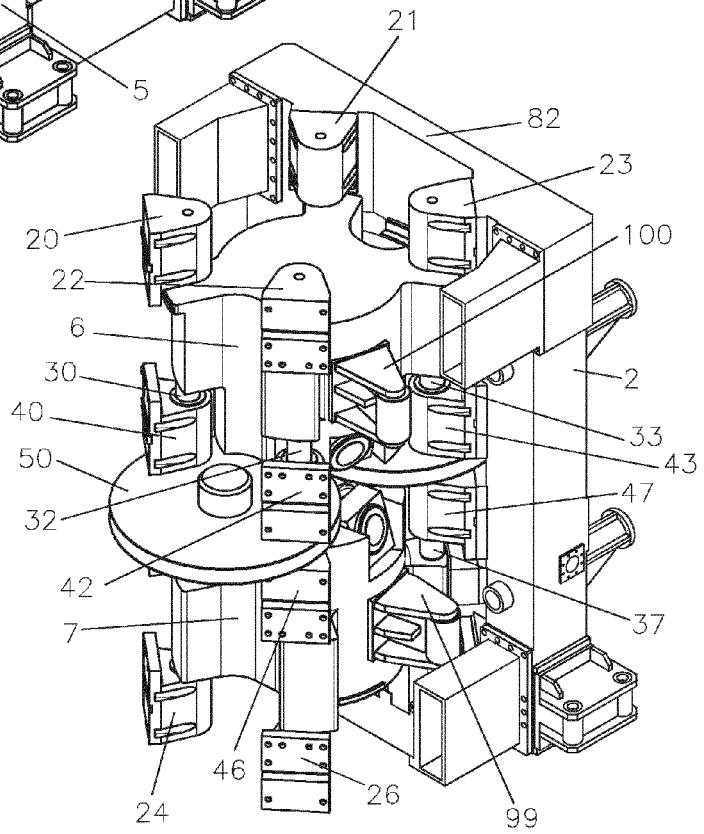
FIG. 2B shows a partially cross-sectioned axonometric view of a component of the rolling stand in FIG. 1A.
Figure 3A:
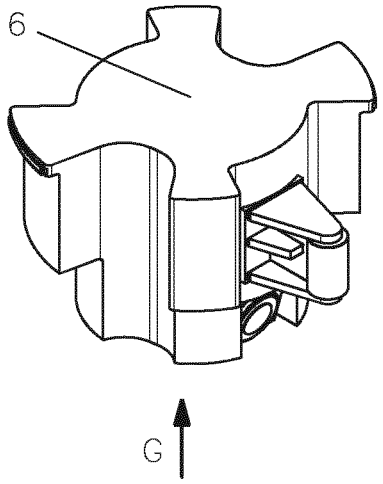
FIG. 3A shows an axonometric view of a detail of the rolling stand in FIG. 1A.
Figure 3B:
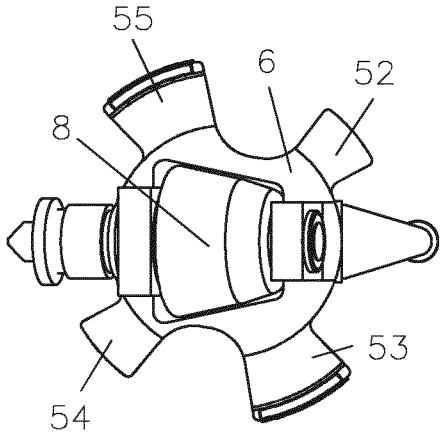
FIG. 3B shows a view of the detail in FIG. 3A in the direction of arrow G.
Figure 3C:
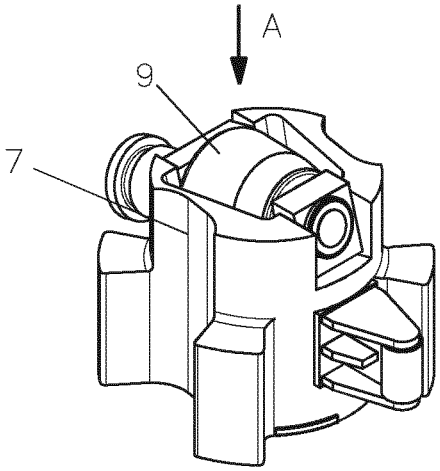
FIG. 3C shows an axonometric view of another detail of the rolling stand in FIG. 1A.
Figure 3D:
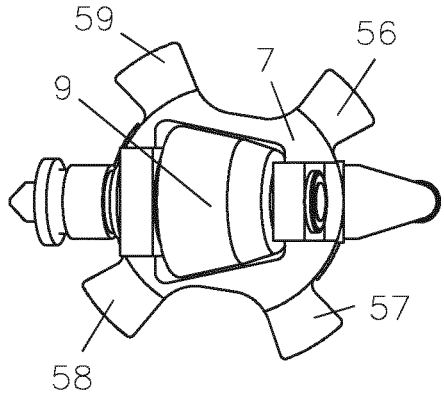
FIG. 3D shows a view of the detail in FIG. 3C in the direction of arrow A.

With particular reference to FIGS. 1A to 1D, a rolling stand is shown in its entirety, globally indicated with numeral 1, which comprises a frame or support structure with four columns 2, 3, 4, 5 which are fixed to the ground, a left shoulder 81 and a right shoulder 82.

Arranged in the lower part of the frame is a left shifting frame 84 of a left disc guide 50 with a left reducer 83' and a shifting frame 85 of a right disc guide 51 with a right reducer 83". A horizontal blocking element 86, 87 for the left disc guide 50 and a horizontal blocking element 88, 89 for the right disc guide 51 are provided, in addition to a vertical blocking element 90 for the left disc guide 50 and a vertical blocking element 91 for the right disc guide 51. The two disc guides 50 and 51 are adjusted by means of a control system 92 and serve the purpose of guiding the tube during rolling. The discs on the disc guides 50 and 51 are motorized, although for the sake of simplicity, the motors are not shown in the figures.

Stand 1 comprises an upper roll cradle 6 and a lower roll cradle 7 arranged within the space delimited by the four columns 2, 3, 4, 5 and by the left 81 and right 82 shoulders. The upper conical working roll 8 is fixed to the upper roll cradle 6, while the lower conical working roll 9 is fixed to the lower roll cradle 7.

Stand 1 also comprises four upper hydraulic jacks comprising two pistons 10, 11, 12, 13 and respective hydraulic chambers 20, 21, 22, 23 which are integral with the columns 1, 2, 3 and 4. It also comprises four lower hydraulic jacks, formed by pistons 14, 15, 16, 17 and by respective hydraulic chambers 24, 25, 26, 27 which are integral with the columns 1, 2, 3 and 4. The upper hydraulic jacks 10, 11, 12, 13 exercise a downwards force on the upper surface of the upper roll cradle 6 and the hydraulic jacks 14, 15, 16, 17 exercise an upwards force against the lower surface of the lower roll cradle 7. According to the invention, the force exercised by the hydraulic jacks is constant and is with the pistons 10, 11, 12, 13, 14, 15, 16, 17 which are not completely extracted so as to allow the absorption of the elastic deformations of the stand structure during rolling.

Stand 1 also comprises four upper hydraulic capsules, each comprising respective hydraulic piston and chamber 30, 32, 31, 33, 40, 42, 41, 43. Four lower hydraulic capsules are also provided, each comprising respective hydraulic piston and chamber 34, 36, 35, 37, 44, 46, 45, 47. Piston 30, 32, 31, 33 of each upper capsule abuts against a respective abutting surface 52, 53, 54, 55 of the upper roll cradle 6, thus discharging the reaction force on the column to which it is fixed, while piston 34, 36, 35, 37 of each lower capsule abuts against a respective abutting surface 56, 57, 58, 59 on the lower roll cradle 7, thus transferring the reaction force to the column to which it is fixed.

The top views of the upper 6 and lower 7 roll cradles reveal their unique shape, which comprises peripheral lobes on which the mentioned push surfaces 52, 53, 54, 55 and 56, 57, 58, 59 are arranged of the pistons of the capsules. The two upper 6 and lower 7 roll cradles are each provided with a respective radial control arm 100 and 99. The angle adjustment control 93 operated by a jack and the angle adjustment jack 95 act on arm 100 of the upper roll cradle 6. The angle adjustment control 94 operated by a jack and the angle adjustment jack 96 act on arm 99 of the lower roll cradle 7.

The hydraulic jacks are aligned with the capsules so that two capsules are coaxial to the two jacks so as to have groups of two jacks and two capsules aligned along a same axis parallel to axis Z. This advantageously avoids misalignments of the forces generated during the rolling, which could generate unwanted bending moments on the roll cradles 6, 7.

It is known by the skilled person that the hydraulic capsules differ from the hydraulic jacks in that the position of the pistons of the capsules is precisely controlled and may be adjusted, because a linear position transducer is assembled on each hydraulic capsule and the piston is double-acting, with inflow and outflow control of the oil with feedback servo valves, so as to position the roll cradles 6 and 7 with increased precision, while the hydraulic jacks can only exercise pressure force on the respective roll cradle on which they apply their force.

Figure 4:
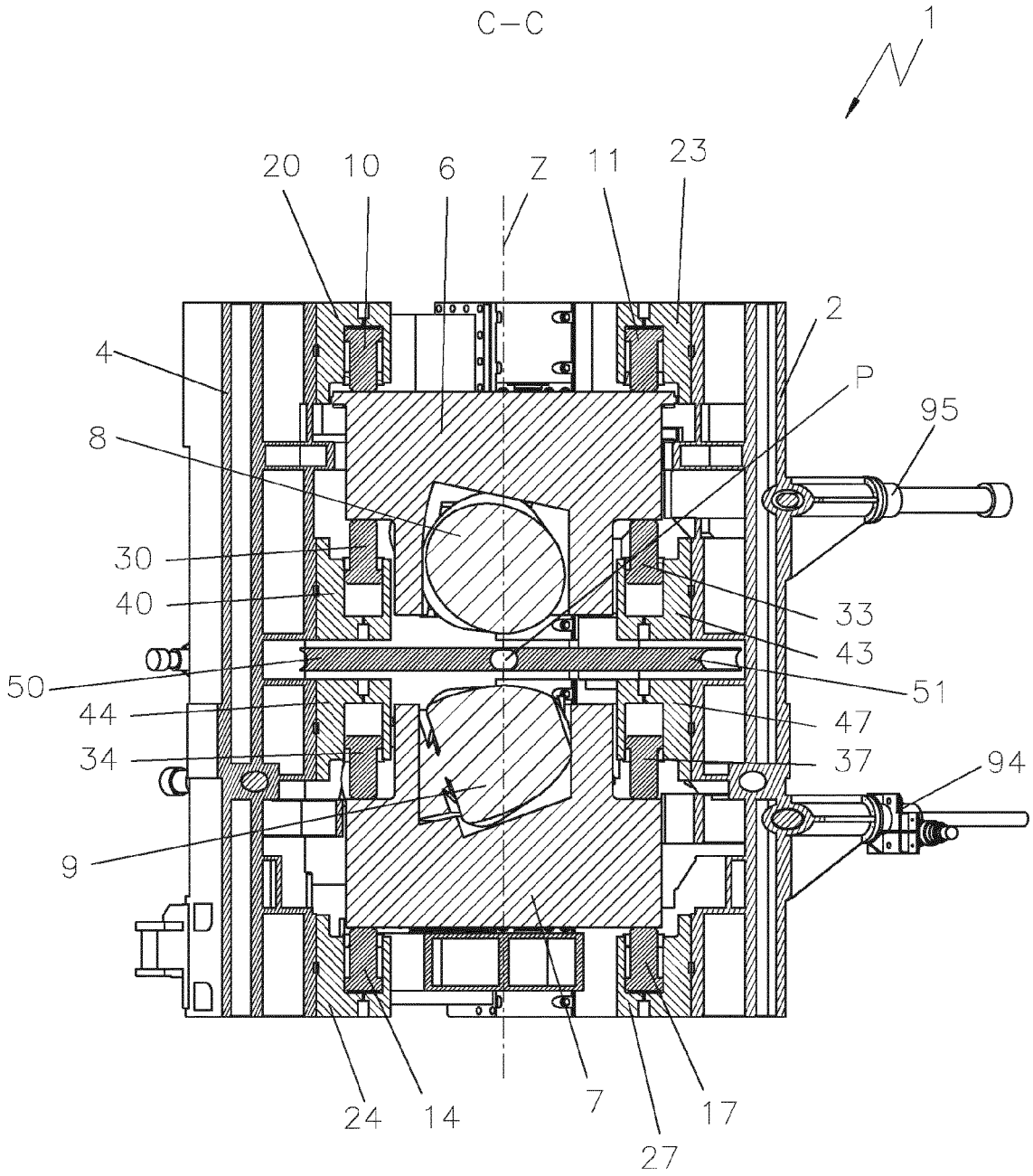
FIG. 4 shows a section along the plane C-C of the rolling stand in FIG. 1D, in a first operating configuration.
Figure 5:
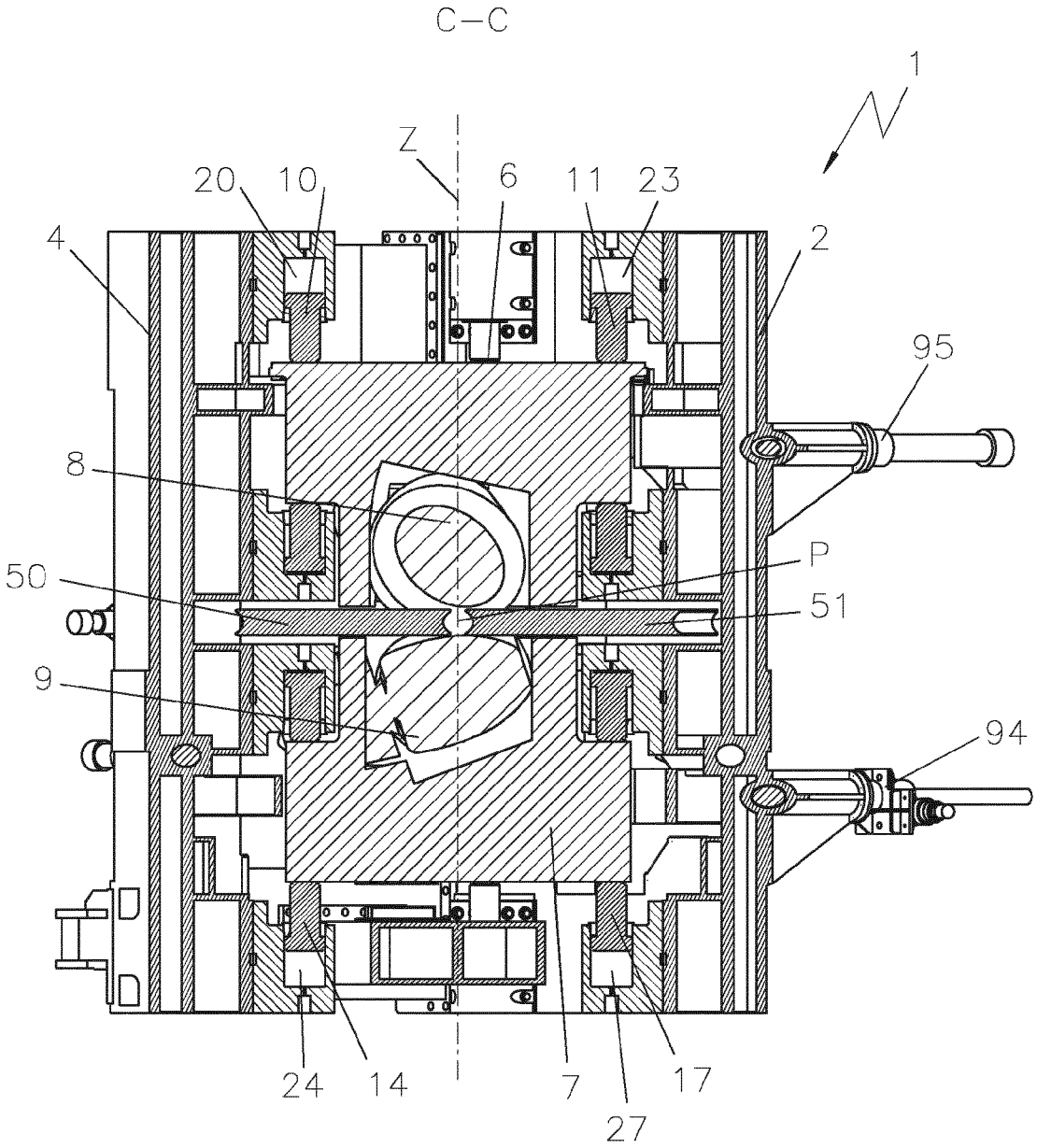
FIG. 5 shows a section along the plane C-C of the rolling stand in FIG. 1D, in a different operating configuration.
Figure 6:
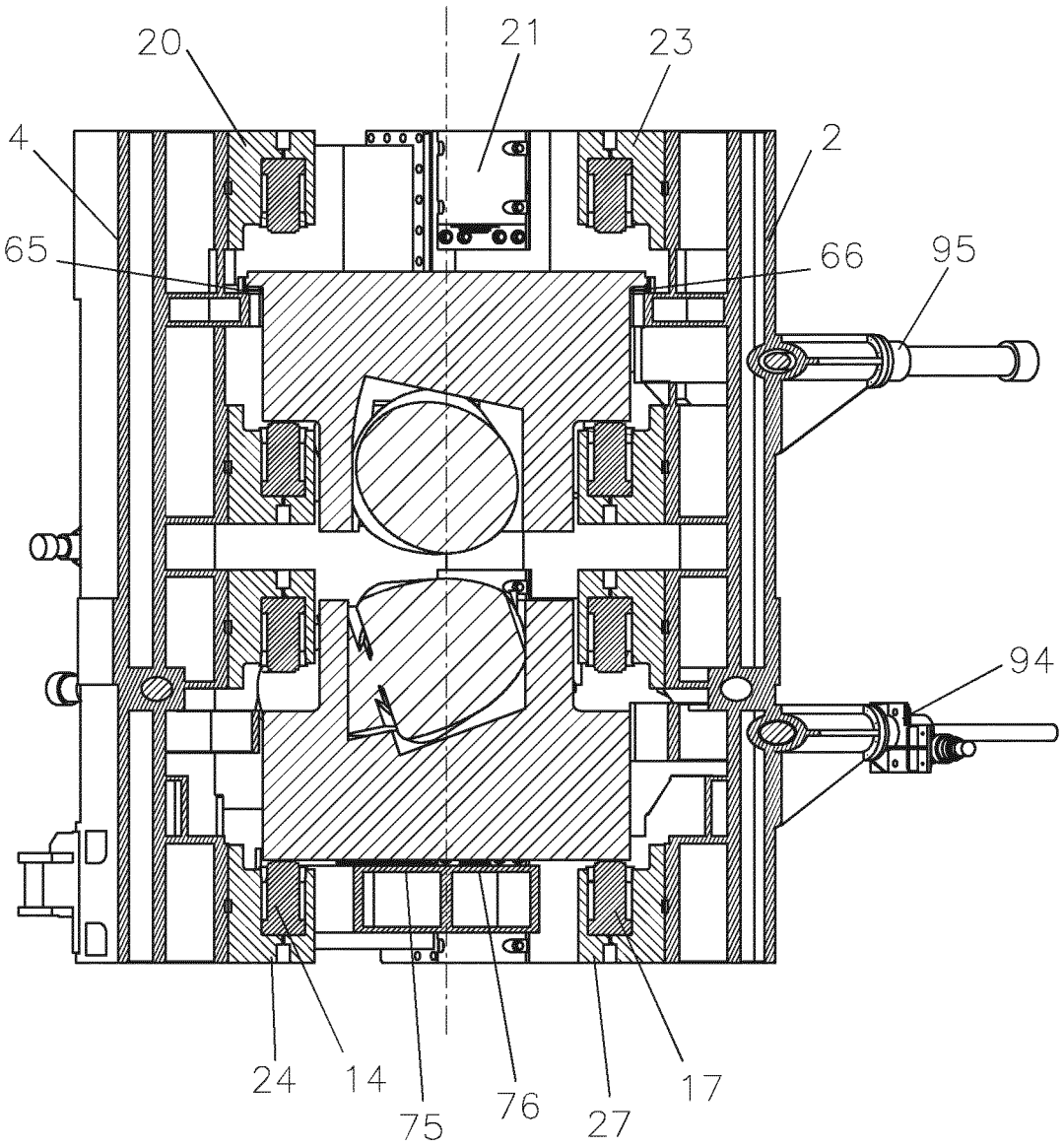
FIG. 6 shows a section along the plane C-C of the rolling stand in FIG. 1D, in a different operating configuration from the preceding ones.

The two roll cradles 6 and 7 may shift vertically in direction of the vertical axis Z of stand 1 so as to allow a separation or nearing of the working rolls 8, 9 according to the product to be rolled by means of the coordinated operation of the jacks and the capsules. The position of maximum reciprocal spacing, that is the maximum opening, of the working rolls 8, 9 is depicted in FIG. 4, while the position of minimum reciprocal spacing between the working rolls 8 and 9, that is with minimum rolling space P, of maximum closing is depicted in FIG. 5.

Control means are also provided of the position and of the forces exercised by the hydraulic capsules, for example these may advantageously be a hydraulic circuit controlled by a circuit or electronic processor for defining and keeping the position between the roll cradles 6, 7 and consequently between the working rolls 8, 9 during the rolling.

The blocked position of the roll cradles 6 and 7 in stand 1 in which they are during the rolling operations of the metal product in various operating positions of the rolls is the one depicted in FIGS. 2A, 2B, 4, 5, 7 and 8.

Furthermore, the replacement of the roll cradles, in order to replace the rolls for maintenance, for example worn rolls, or when the size is changed of the product to be rolled, may be carried out by means of a simple and fast operation hereinafter described. The unblocked position for replacing the upper roll cradle 6 rotated about axis Z by a predefined angle with respect to the blocked position, which allows it to be extracted from stand 1 or inserted into stand 1 with an axial movement in direction of axis Z, is depicted in FIGS. 1A to 1D, 6, 9.

Figure 10:
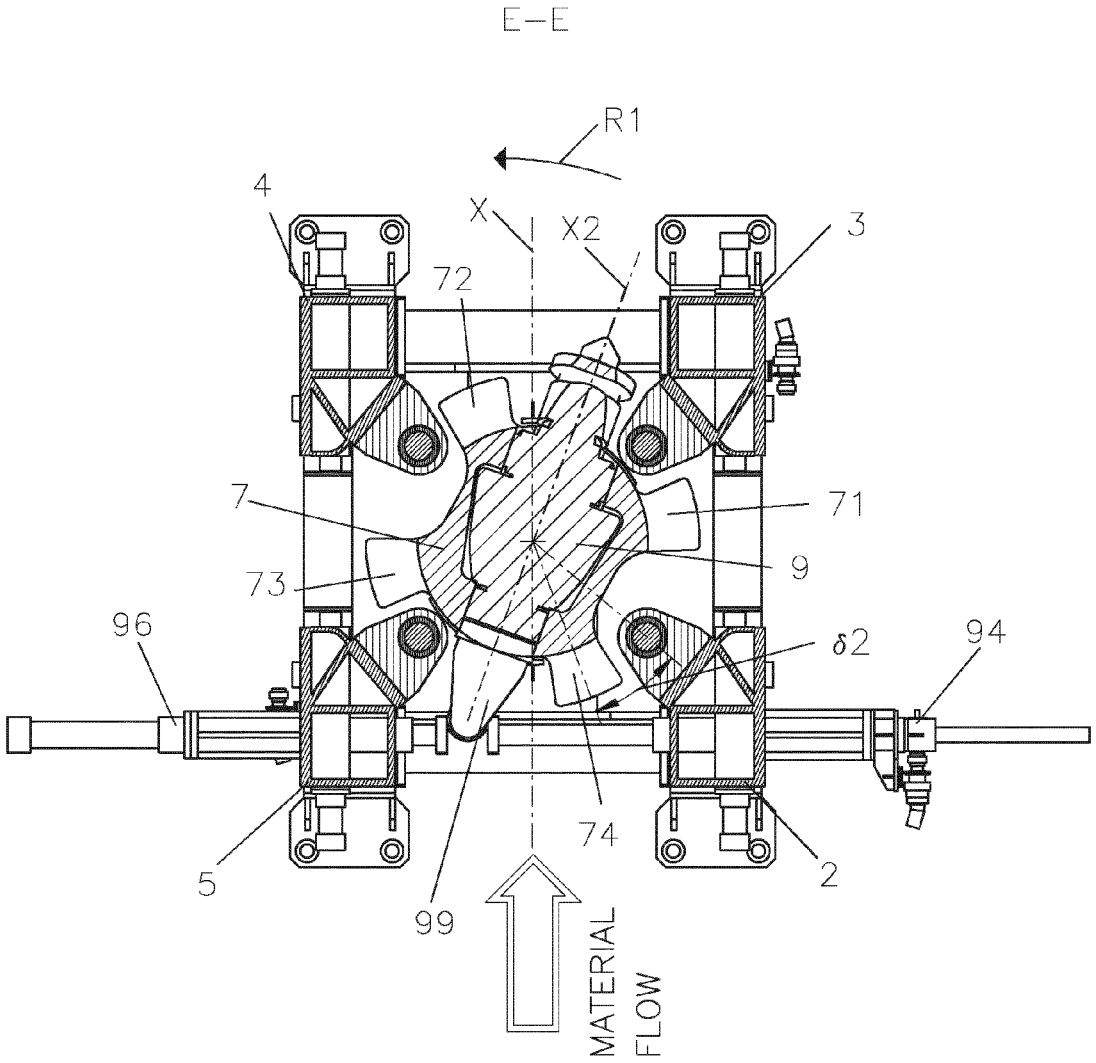
FIG. 10 shows a section along the plane E-E of the rolling stand in FIG. 1C, in an operating configuration which is different from the one in FIG. 8.

The unblocked position for replacing the lower roll cradle 7 rotated about axis Z by a predefined angle with respect to the blocked position, which allows it to be extracted from stand 1 or inserted into stand 1 with an axial movement in direction of axis Z, is depicted in FIG. 10.

Starting with the description of the procedure for assembling the two working rolls 8, 9, it occurs in the rolling stand as follows. The space provided between the four columns 2, 3, 4, 5 is intended to receive the roll cradles 6 and 7 with the respective working rolls 8, 9. The lower roll cradle 7, integrally fixed to its working roll 9, is inserted from the Q of stand 1, by translating it in direction of the vertical axis Z of stand 1, in an angular position rotated by an angle δ2 about axis Z and with its rolling roll 9 arranged upwards. Angle δ2 corresponds to the angular rotation required to have the roll cradle take on its final fixed position in the stand.

Thereby, the lobes 71, 72, 73, 74, which define with each other longitudinal passages with sufficient width so as not to interfere with the volume of the hydraulic jacks and with the capsules, are positioned in angular sectors which do not interfere with the positions of the upper hydraulic jacks and with the positions of the upper and lower hydraulic capsules during the translation of roll cradle 7 along axis Z. The lower roll cradle 7 is caused to descend to its abutting position at the lower hydraulic jacks, while resting roll cradle 7 on supporting surfaces 75, 76 located below the roll cradle, and integral with stand (1).

Roll cradle 7 is then caused to rotate about axis Z by an angle equal to δ2 in the direction of arrow R1, by means of the action of the jack on the angular adjustment control 94 and of the angular adjustment jack 96 on arm 99. Thereby, each lobe 71, 72, 73, 74 is positioned at the piston of the respective jack 14, 15, 16, 17, below and underneath the respective capsules 44, 45, 46, 47. Roll cradle 7 is thus inserted within the blocking jack 98.

Figure 7:
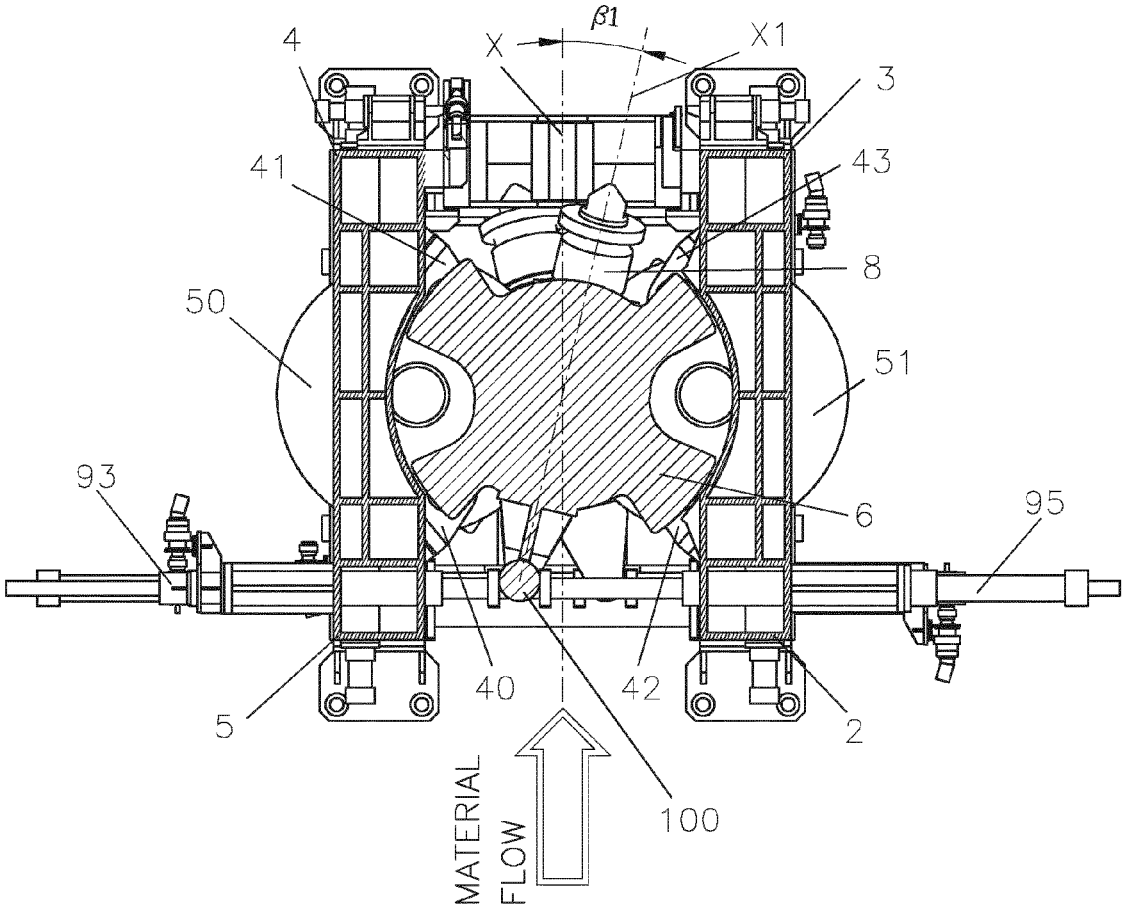
FIG. 7 shows a section along the plane D-D of the rolling stand in FIG. 1C.
Figure 8:
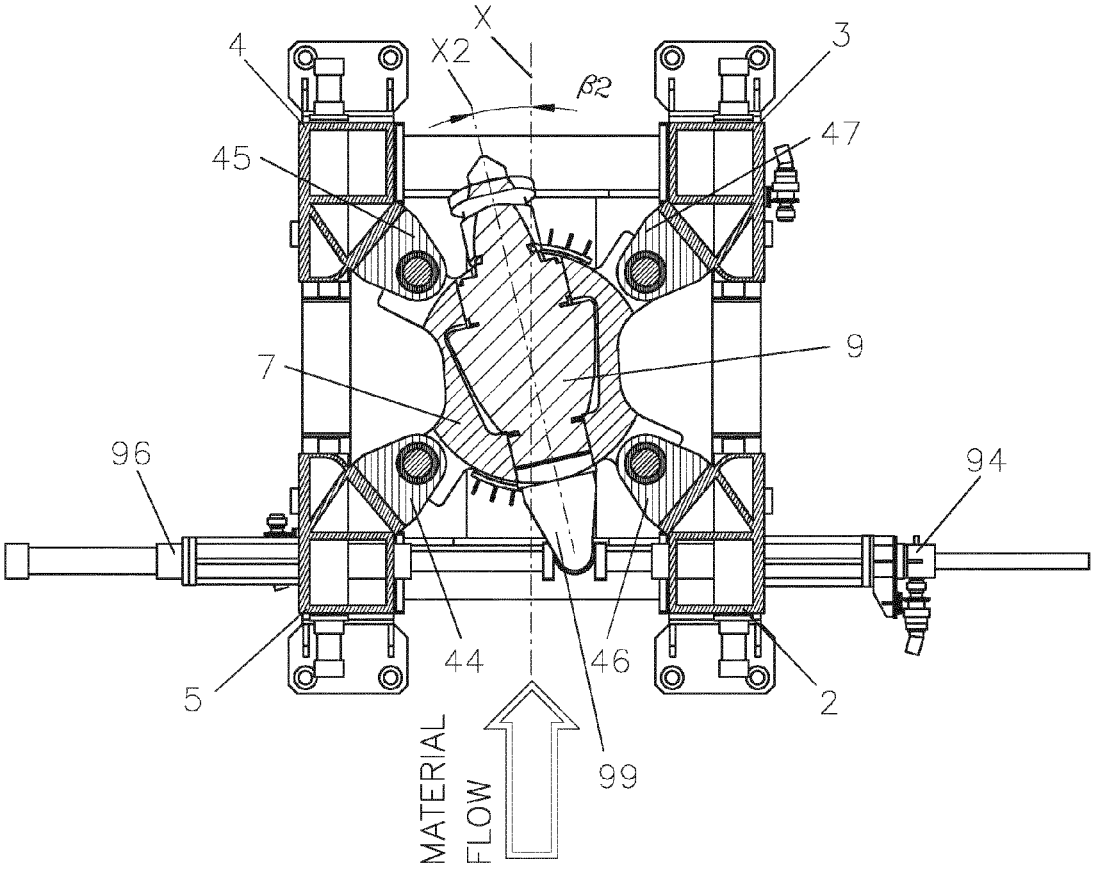
FIG. 8 shows a section along the plane E-E of the rolling stand in FIG. 1C.
Figure 9:
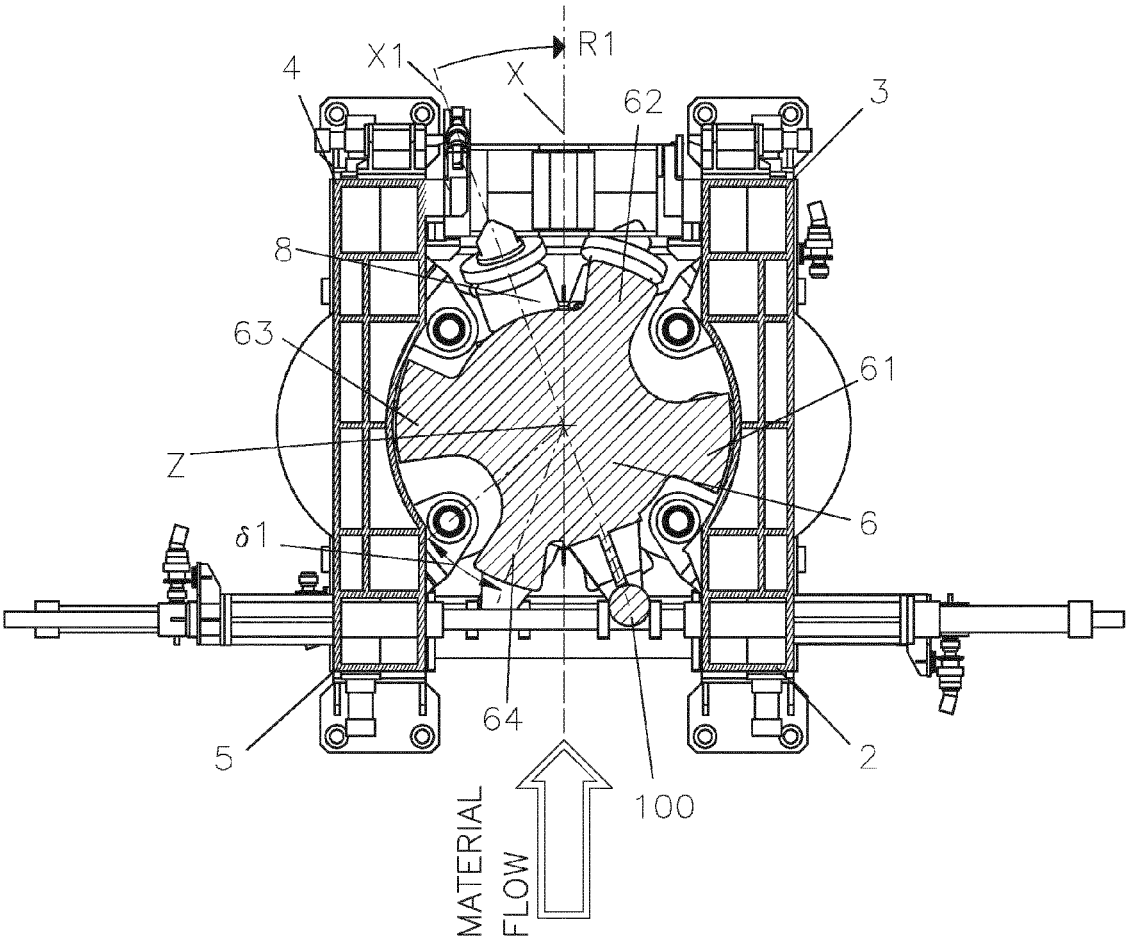
FIG. 9 shows a section along the plane D-D of the rolling stand in FIG. 1C, in an operating configuration which is different from the one in FIG. 7.

The assembly operation hence continues with the insertion of the upper roll cradle 6 from the Q of stand 1, the respective working roll 8 being arranged downwards and integrally fixed to the upper roll cradle 6. Similarly to the lower roll cradle 7, the upper roll cradle 6 is moved forwards by translating it in the direction of the vertical axis Z, and arranged in an angular position rotated by an angle δ1 about axis Z, which is angularly offset with respect to the final blocked operating position. Thereby, the lobes 61, 62, 63, 64 of roll cradle 6 are positioned in angular sectors which do not interfere with the positions of the upper hydraulic jacks which are along the path of the upper roll cradle 6. After descending to the resting level in stand 1, which is delimited by two abutting annular surfaces 65, 66, as seen in FIGS. 4 and 7, so the weight of the upper roll cradle 6 does not weigh on the capsules 30, 32, 31, 33, 40, 42, 41, 43, the upper roll cradle 6 is rotated by an angle equal to δ1 about axis Z in the direction indicated by arrow R1, by means of the action of the jack on the angular adjustment control 93 and of the angular adjustment jack 95 on arm 100. At the end of such an operation, each lobe 61, 62, 63, 64 goes to the respective capsules 30, 32, 31, 33, 40, 42, 41, 43 below and underneath the respective hydraulic jack.

The extraction of the roll cradles 6 and 7 of the working rolls 8, 9 occurs similarly, but by proceeding inversely in the various assembly operations described. Thereby, the assembly and disassembly operations of the roll cradles and of the working rolls occur simply and quickly, thus saving operating time.

The rolling of the tube performed with the assembled rolling stand is carried out according to well-known processes and hence the rolling operation is only briefly described.

The non intersecting, oblique rotating axes X1 and X2 of the two rolls 8, 9 are arranged tilted on various sides with respect to the rolling axis X, by respective angles β1 and β2, and thereby an angle β is formed between the two axes X1 and X2 of the working rolls, given by the sum of the two angles β1 and β2.

The two working rolls 8, 9 press outside the tubular or solid body, in any event of substantially cylindrical shape and push it in rotation onto the point arranged within the tubular body, and a resulting helical advancing motion is obtained from these combined rotating motions, and thereby the tubular body undergoes a process of deformation in the advancement thereof between the two rolls and the point.

In particular, the thickness of the tubular body is progressively reduced in its advancing motion between roll and point starting from the inlet into the rolling stand, and simultaneously the length of the tubular body increases between the inlet into and outlet from the rolling mill.

The helical advancing motion of the tubular body during rolling takes on characteristics which vary based on the values of angle β and of the distances between the two axes X1 and X2 of the rolls or between the conical surfaces of the rolls. The variation of angle β is generated by the combined action of the angular adjustment control 94 and of the angular adjustment control 93.

In an advantageous variant of the rolling stand of the invention, the point is assembled on a rod held by specific triad guide devices 97 with related opening and blocking services, which are located on the outlet side of the machine. These devices are commonly used in piercing rolling mills, which are progressively opened as the tubular body advances.

It is known by field technicians that the rolling forces are discharged on the rolling stand structure, thus deforming it. Due to the characteristics of the stand of the invention, it's possible to preload the roll cradles by means of loading jacks. Due to the activation of the preloading system on hydraulic capsules located close to the rolling axis, the deformation of the stand which involves the positioning of the roll cradles, and of the respective working rolls, involves much lower values than the ones for rolling stands of the state of the art, because a much more contained portion of stand is involved, equal only to the distance between the hydraulic capsules and the rolling axis.

It's important to underline that although the embodiment of the rolling stand of the invention refers to the vertical arrangement of the stand, that is in the case in which axis Z is vertically arranged with the two roll cradles arranged one above the rolling axis X and one below the rolling axis, it's clear to the field technician that, without departing from the scope of the present invention, a variant of the rolling stand of the invention consists of the rolling stand arranged horizontally, that is with the longitudinal axis Z' of the rolling stand and axis X horizontal, and with the two working rolls arranged at the two sides of the rolling axis X. In this variant, the rolling stand consists of the same components, and differs from the main variant of the invention only in the arrangement of the stand in horizontal position. In this variant, the two roll cradles, which are no longer upper and lower but lateral, may be laterally extracted one roll per side of the stand by removing them along the horizontal longitudinal axis Z' of the stand. This arrangement prevents the need to design the stand with an openable upper element to replace working rolls. The assembly and disassembly operations are similar to the ones described above for the vertical stand, with the difference that the direction of the movements indicated as vertical are to be interpreted as horizontal. Furthermore, in this second variant, both the insertion and the extraction of the two roll cradles, no longer upper and lower but lateral with respect to the rolling axis X, may be advantageously carried out simultaneously, although the extraction and assembly may also be carried out in sequence from the two sides of the stand.

The embodiments of the rolling stand of the invention described mainly provide the use of conical working rolls, however it's clear to the field technician that a pair of working rolls may also be provided having barrel-shaped rolling surfaces, without departing from the scope of the invention.

The embodiments of the invention may be used both on piercing rolling mills and on elongator rolling mills, whether or not they operate on a mandrel or plug. Furthermore, it's also possible to use the variants of the invention combined with fixed line guides instead of disc guides 50, 51. The accessory elements described above for the embodiment with the disc guides with control, shift, blocking functions are also the same in this embodiment.

The invention claimed is:

1. A rolling stand defining a rolling, axis comprising a support structure having a longitudinal axis which is orthogonal to the rolling axis, a first and a second working roll having peripheral surfaces facing each other and defining a rolling passage, said first and second working rolls having skewed axes to each other, a first and a second roll cradle, wherein said first roll cradle integrally supports the first working roll and said second roll cradle integrally supports the second working roll, characterized in that it provides at least two first hydraulic jacks arranged and configured to exercise first pushing forces on surfaces of the second roll cradle distal from the rolling passage, at least two second hydraulic jacks arranged and configured in order to exercise second pushing forces in an opposite direction to the first pushing forces on surfaces of the first roll cradle distal from the rolling passage, at least two first hydraulic capsules arranged and configured to exercise third pushing forces on surfaces of the first roll cradle proximal to the rolling passage and to define a reciprocal distance between the first and the second roll cradle, at least two second hydraulic capsules arranged and configured to exercise fourth pushing forces on surfaces of the second roll cradle proximal with respect to the rolling passage and to define a reciprocal distance between the first and the second roll cradle in cooperation with the at least two first hydraulic capsules, control means for controlling position of said first and second roll cradles configured in order to control position and pushing forces of the at least two first hydraulic capsules and of the at least two second hydraulic capsules, of the pushing forces of the at least two first hydraulic jacks and of the at least two second hydraulic jacks; and wherein the first and the second roll cradles have a respective peripheral surface provided with indentations and protrusions arranged in alternating succession and are configured to allow removal, of the hydraulic jacks and the hydraulic capsules from the stand in the direction of the longitudinal axis during assembly and disassembly of the first and the second roll cradles.

2. A rolling stand according to claim 1, wherein one of the at least two first hydraulic capsules is axially aligned with one of the at least two second hydraulic capsules, with one of the at least two first hydraulic jacks and with one of the at least two second hydraulic jacks and with axes parallel to the longitudinal axis.

3. A rolling stand according to claim 1, comprising four first hydraulic capsules, four second hydraulic capsules, and four first hydraulic jacks and four second hydraulic jacks.

4. A rolling stand according to claim 1, wherein first and second working rolls have conical peripheral rolling surfaces.

5. A rolling stand according to claim 1, wherein the first and second working rolls have barrel-like peripheral rolling surfaces.

6. A rolling stand according to claim 1, wherein the rolling stand is arranged with the longitudinal axis vertical.

7. A rolling stand according to claim 1, wherein the rolling stand is arranged with the longitudinal axis horizontal.

8. A rolling stand according to claim 6, wherein said support structure has a static left shoulder and a static right shoulder fixed to one another.

9. A method for assembling a rolling stand according to claim 1, comprising the following steps.

a) rotating the second roll cradle of an angle 62 2 around the longitudinal axis with respect to its predetermined final working position and shifting the second roll cradle in the direction of the longitudinal axis within the support structure of the rolling stand to a position in correspondence of the first hydraulic jacks, b) rotating the second roll cradle around the longitudinal axis of an angle δ2, so that each first lobe is placed in correspondence of the respective first hydraulic jack and placing the second roll cradle in its working position, c) positioning the first roll cradle in an angular position rotated by an angle δ1 about the longitudinal axis with respect to its predetermined final working position and shifting the first roll cradle in the direction of the longitudinal axis within the support structure of the rolling stand to a position in correspondence of the first hydraulic capsules, d) rotating the first roll cradle about the longitudinal axis of an angle δ1, so that each second lobe is placed at the respective first hydraulic capsule and placing the first roll cradle in its working position.

10. A method according to claim 9, wherein the rolling stand is positioned with the longitudinal axis horizontal and the first and second roll cradles are inserted from two opposite sides of the rolling stand.

11. An method according to claim 9, wherein the rolling stand is positioned with the longitudinal axis vertical and the second roll cradle is inserted from the upper part of the rolling stand before the first roll cradle.

12. A rolling method by means of a rolling stand according to claim 1, wherein an adjustment of a distance between first and second roll cradles along the longitudinal axis is carried out under load during rolling of the metal product.

* * * * *